US006196013B1

(12) United States Patent
Kim

(10) Patent No.: US 6,196,013 B1
(45) Date of Patent: Mar. 6, 2001

(54) FAN CASING OF WINDOW TYPE AIR CONDITIONER

(75) Inventor: Jae-Soon Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/233,496

(22) Filed: Jan. 20, 1999

(30) Foreign Application Priority Data

Feb. 19, 1998 (KR) ..... 98-5202

(51) Int. Cl.[7] ..... F25D 23/12; F25D 19/00; F25D 17/06

(52) U.S. Cl. ..... 62/262; 62/296; 62/428

(58) Field of Search ..... 62/262, 298, 296, 62/428

(56) References Cited

U.S. PATENT DOCUMENTS 3,756,039 * 9/1973 Riello ..... 62/262
3,805,542 * 4/1974 Hosoda et al. ..... 62/262
3,906,741 * 9/1975 Terry ..... 62/262
5,329,784 * 7/1994 Kennedy et al. ..... 62/262

FOREIGN PATENT DOCUMENTS

62530 * 4/1985 (JP) ..... 62/262
134129 * 7/1985 (JP) ..... 62/262

* cited by examiner

*Primary Examiner*—William Doerrler
(74) *Attorney, Agent, or Firm*—Robert E. Bushnell, Esq.

(57) ABSTRACT

A fan casing for a window type air conditioner adapted to change improve the flow of external air sucked through the fan. The window type air conditioner has an outer panel formed with a plurality of draft holes for suction of external air, and an outdoor casing disposed at an exterior space of the air conditioner for sucked air to be dispersed and discharged into a condenser in response to rotation of an outdoor fan. The outdoor casing is so formed as to be smoothened in corners thereof in slow curvatures. This enlarges the length of the draft holes, thereby increasing a sucked amount of external air and reducing disturbance and resistance of air flow to decrease eddy currents and noise.

8 Claims, 3 Drawing Sheets

FAN CASING OF WINDOW TYPE AIR CONDITIONER

BACKGROUND OF THE INVENTION

1. Field of the Invention

The present invention relates to a window-type air conditioner, and more particularly to a fan casing for a window-type air conditioner adapted to improve the flow of external air sucked through the fan.

2. Description of the Prior Art

A window-type air conditioner according to the prior art includes, as illustrated in FIGS. 1 and 2: a base panel 10, an evaporator 20, a blade frame 30, and a control casing 40. The evaporator 20 and blade frame 30 are connected by an indoor casing 50, control casing 40 is screwed to a side of evaporator 20 and to a bottom surface (not shown) of blade frame 30. Blade frame 30 has a plurality of vertical blades 60 for horizontal control of air flow.

Base panel 10 is connected at an upper surface thereof to an outer panel 70 which has at both sides thereof a plurality of draft holes 71. Outer panel 70 is attached to a front panel 80 for forming an exterior appearance of the air conditioner and for concurrently sucking and discharging the room air.

Front panel 80 includes a suction grille 81, a discharge grille 82 and a plurality of horizontal blades 90 for controlling the flow. Base panel 10 supports a compressor 100 and an outdoor casing 110. Between outdoor casing 110 and indoor casing 50 are a plurality of gap brackets 120.

Referring to FIG. 2, between indoor casing 50 and outdoor casing 120 is located a fan 150 for sucking the room air and external air into an inner space 145 and an outer space 140, circulating the interiors thereof and discharging the same outside. A condenser 130 is located in interior space 145.

Fan 150 includes a motor 151, having attached thereto an inner fan blade 152, and an outer fan blade 153 disposed at through-hole 111 of outdoor casing 110.

A problem exists in conventional window-type air conditioners thus constructed, in that the plurality of draft holes 71 arranged at both walls of the outer panel 70 are formed shortened at lengths (La) thereof to limit influx of external air through the plurality of draft holes 71 and this may result in an insufficient amount of air passing therethrough, thereby leading to insufficient cooling of condenser 130. Another problem is that the air sucked through the outer space 140 becomes vertical by being resisted and disturbed in flow thereof by corners of outdoor casing 110, thereby generating noise.

SUMMARY OF THE INVENTION

The present invention is intended to solve the aforementioned problems. It is therefore an object of the present invention to provide a fan casing for a window-type air conditioner, that is adapted to smooth and form corners of outdoor casing in slow curvatures and to increase the length of the draft holes, thereby improving flow of external air, and reducing disturbance and resistance of air flow, decreasing eddy currents and decreasing noises.

To accomplish these objects of the invention, a fan casing is provided for a window-type air conditioner. The casing has an outer panel formed with a plurality of draft holes for suction of external air, and an outdoor casing disposed at an external space of the air conditioner for sucked air to be dispersed and discharged into a condenser according to rotation of an outdoor fan. The outdoor casing is so formed as to be smoothened in the corners thereof in slow curvatures and to increase the length of draft holes, thereby increasing the sucked amount of external air, reducing disturbance and resistance of air flow, decreasing eddy currents, and decreasing noise.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
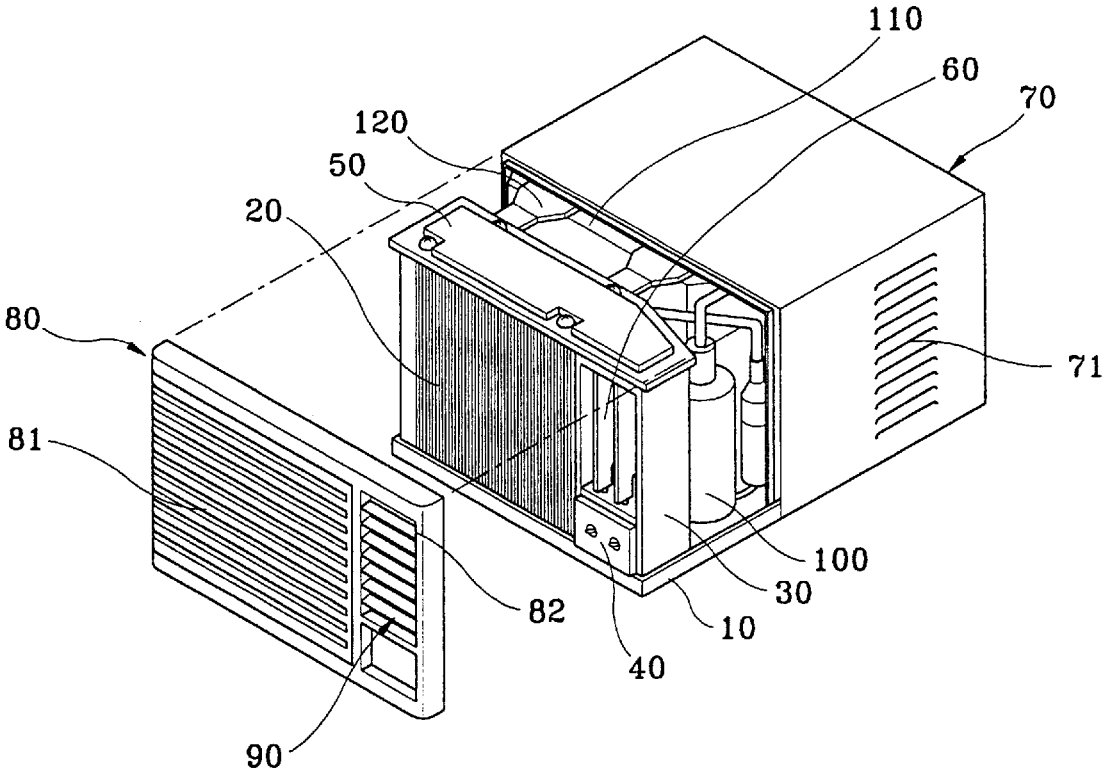
FIG.1 PRIOR ART
FIG. 1 is a perspective view of a conventional window-type air conditioner.
Figure 2:
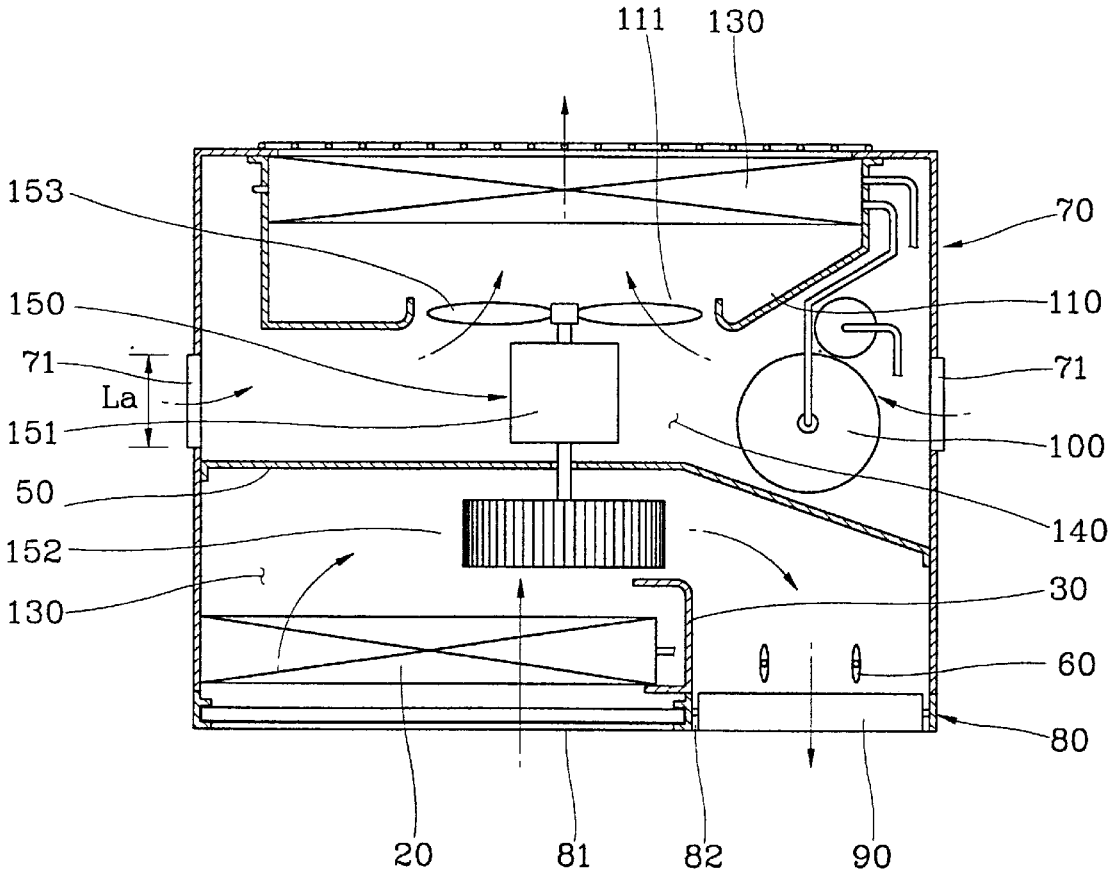
FIG.2 PRIOR ART
FIG. 2 is a plan view of a conventional window-type air conditioner.

A preferred embodiment of the present invention will now be described in detail with reference to FIG. 3. Like reference numerals and symbols are used for designation of like or equivalent parts or portions for simplicity of illustration and explanation.

Figure 3:
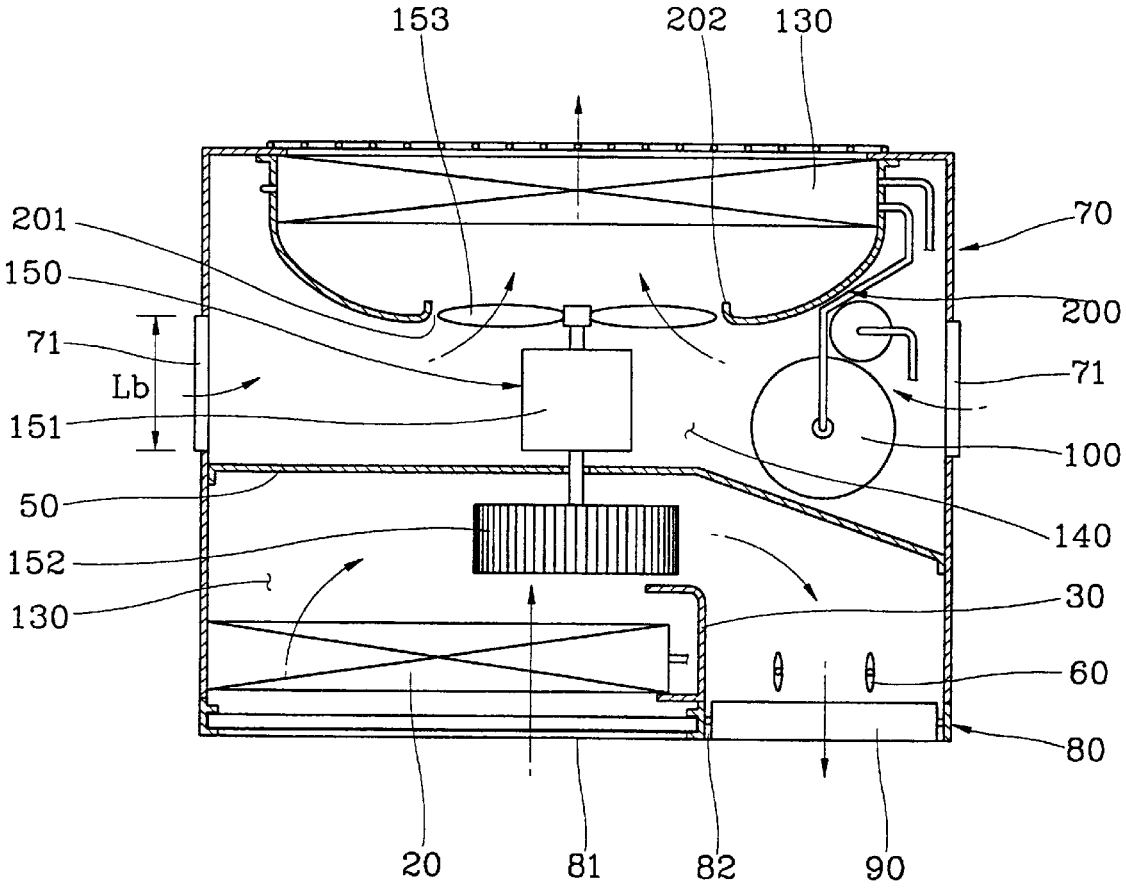
FIG. 3 is a plan view of a window-type air conditioner according to the present invention.

In FIG. 3, reference numeral 200 represents an outdoor casing of curved shape for increasing the amount of sucked external air and simultaneously minimizing disturbance and reduction of air flow. This is accomplished lengthening the lengths(lb) of the plurality of draft holes 71. Also, this obtains a broader accommodation of space for the compressor 100 and secures a larger suction area for external air.

Outdoor casing 200 is injection-molded in synthetic resin to form a bulging curvature and is centrally formed with a through-hole 201, in which outdoor fan 153 is inserted and air passes through through-hole 201 at a periphery of through-hole 201 with a bell mouth 202 is formed.

The operation of the present invention, with an apparatus constructed as above, is as follows:

A motor 151 at blowing means 150 is supplied with electric power to rotate an indoor fan 152 to suck the room air which may in turn be filtered by an air filter (not shown).

The (filtered) air passes an evaporator 20, and is heat-exchanged to cold air, which is in turn discharged along the arrow A1 also guided by an indoor casing 50 disposed at the rear of the evaporator 20. The air passes to a blade frame 30 and is concurrently discharged forward to cool the room. The air is guided by control angles of a plurality of vertical blades 60 and horizontal blades 90 to a desired place in the room.

At the same time, an outdoor fan 153 is rotated. The external air is sucked into an outer space 140 via a plurality of draft holes 71 to cool the compressed heat output from a compressor 100. The air is then discharged along arrow A2 through through-hole 201 and passes the condenser 100 to cool the condensed heat output from the condenser 130.

The air is then discharged along the arrow through the through-hole 201 and passes the condenser 100 to cool the condensed heat output from the condenser 130.

As illustrated in FIG. 3, outdoor casing 200 of a cornerless curved shape, permits increase of the length(lb) of draft holes 71, to thereby increase the amount of sucked external air. Furthermore, the air sucked through the plurality of draft holes 71 into the exterior space 140 is softly guided to flow along curved outdoor casing 200 to outdoor fan 153, to reduce eddy currents and noises.

As apparent from the foregoing, there is an advantage in the fan casing of a window-type air conditioner according to the present invention has the advantages that the corners of the outdoor casing are smoothed to form slow curvatures, and a plurality of draft holes are increased in length thereby increasing amount of sucked air and reducing resistance of air flow, to decrease eddy currents and noises due to turbulence caused by sudden changes of direction of airflow.

What is claim is:

1. In a fan casing for a window-type air conditioner adapted for insertion along a longitudinal axis thereof into a window or wall aperture of a building, said air-conditioner having a front end at a portion of the air conditioner facing outwards from the building, a rear end at a portion of the air conditioner facing into the building, and a right side and a left side, each side of the air conditioner extending longitudinally from the front end of the air conditioner to the rear end of the air conditioner, said air conditioner comprising:

a front compartment located centrally at the front end of the air conditioner and extending into the air conditioner toward the rear end thereof, said front compartment adapted for venting air outwards from the building via apertures at the front end of the air conditioner;

extending rearwards from the front end of the air conditioner and distanced inwardly from the right side of the air conditioner and from the left side of the air conditioner, an outdoor casing enclosing the front compartment on a right side, a left side, and a rear side thereof, said outdoor casing having a through-hole centrally located therein, said through-hole having an expeller fan blade located therein, said expeller fan blade mounted on a motor shaft and adapted for blowing air into the front compartment and expelling air therefrom out of the building;

a motor compartment located rearwards of the front compartment and on each side thereof, separated from the front compartment by the outdoor casing and opening to the front compartment via the through-hole, said motor compartment having a right portion extending from the right side of the front compartment to the right side of the air conditioner, the right side of the air conditioner providing a right side of the front compartment, and a left portion extending from the left side of the front compartment to the left side of the air conditioner, the left side of the air conditioner providing a left side of the front compartment, each side of the motor compartment containing an air opening a first means for permitting room air to be sucked into the air conditioner, said first means comprising a second means for providing a total throughput area A1 for sucking room air, said second means comprising a third means for permitting air to be sucked into the motor compartment and passed through the motor compartment to the front compartment without noise and turbulence.

2. A method of improving airflow within a window-type air conditioner, whereby suction of air is increased without increasing turbulence and noise, said air-conditioner having right and left side panels formed with a means for sucking room air into the air conditioner, and an outdoor casing disposed within the air conditioner for guiding sucked air to be passed to a condenser within a front compartment of the air conditioner and thereafter expelled outdoors, said method comprising:

(1) providing said air conditioner with an improved outdoor casing so formed as to embody a means for providing the air conditioner with an increased suction of room air without increasing turbulence and noise; and (2) operating the air conditioner with the improved outdoor casing.

3. A method of reducing noise in a window-type air conditioner, said air-conditioner having right and left side panels formed with a means for sucking room air into the air conditioner, and an outdoor casing disposed within the air conditioner for guiding sucked air to be passed to a condenser within a front compartment of the air conditioner and thereafter expelled outdoors, said method comprising:

(1) providing said air conditioner with an improved outdoor casing so formed as to embody a means for providing the air conditioner with an increased suction of room air without increasing tubulence and noise; and (2) operating the air conditioner with the improved outdoor casing.

4. A fan casing according to claim 1, wherein a plan view cross-section of the outdoor casing has a curved shape bulging toward the expeller fan blade.

5. A fan casing according to in claim 1, wherein the outdoor casing is made of synthetic resin.

6. The method of claim 2, wherein the fan casing has a horizontal cross-sectional curved shape bulging toward the expeller fan blade.

7. The method of claim 2, wherein the outdoor casing is made of synthetic resin.

8. The method of claim 2, wherein said improved outdoor casing is so formed in gradual, elongated, arcuate curvatures as to have radii of curvature at least substantially as great as a longitudinal extent of the front compartment.

* * * * *